US012295496B2

(12) United States Patent
Holm

(10) Patent No.: US 12,295,496 B2
(45) Date of Patent: May 13, 2025

(54) BED SYSTEM AND RELATED METHOD

(71) Applicant: Rotobed ApS, Lunderskov (DK)

(72) Inventor: Martin Riis Holm, Lunderskov (DK)

(73) Assignee: Rotobed ApS, Lunderskov (DK)

( * ) Notice: Subject to any disclaimer, the term of this patent is extended or adjusted under 35 U.S.C. 154(b) by 472 days.

(21) Appl. No.: 17/421,031

(22) PCT Filed: Jan. 17, 2020

(86) PCT No.: PCT/EP2020/051190
§ 371 (c)(1),
(2) Date: Jul. 7, 2021

(87) PCT Pub. No.: WO2020/160890
PCT Pub. Date: Aug. 13, 2020

(65) Prior Publication Data

US 2022/0053942 A1 Feb. 24, 2022

(30) Foreign Application Priority Data

Feb. 7, 2019 (EP) ..... 19156017

(51) Int. Cl.
*A47C 20/04* (2006.01)

(52) U.S. Cl.
CPC ..... *A47C 20/04* (2013.01)

(58) Field of Classification Search
CPC ..... A47C 20/04; A47C 20/041; A47C 20/08; A61G 7/00; A61G 7/053; A61G 7/015; A61G 7/018; A61G 7/16
See application file for complete search history.

(56) References Cited

U.S. PATENT DOCUMENTS

| | | | | |
|---|---|---|---|---|
| 8,793,825 | B2 * | 8/2014 | Tekulve | A61G 7/1076 5/613 |
| 10,932,974 | B2 * | 3/2021 | Eskridge, III | A61G 7/1025 |
| 2007/0017029 | A1 | 1/2007 | Wurdeman | |
| 2010/0005591 | A1 * | 1/2010 | Manouchehri | A61G 7/053 5/618 |
| 2010/0064439 | A1 * | 3/2010 | Soltani | A61G 7/0509 5/618 |

(Continued)

FOREIGN PATENT DOCUMENTS

| | | |
|---|---|---|
| CN | 101541287 | 9/2009 |
| CN | 109199728 | 1/2019 |
| DE | 10 2006 055 205 | 6/2008 |

*Primary Examiner* — Fredrick C Conley

(57) ABSTRACT

A bed system and related method is disclosed, the bed system comprising a bed frame and a mattress assembly pivotably mounted on the bed frame for pivoting the mattress assembly about a pivot axis to form a pivot angle between the mattress assembly and a longitudinal axis of the bed frame, the mattress assembly comprising aback part, a seat part and a leg part, wherein aback normal of the back part and the pivot axis forms a back angle, a seat normal of the seat part and the pivot axis forms a seat angle, and a leg normal of the leg part and the pivot axis forms a leg angle, the bed system comprising a controller device, wherein the controller device is configured to: move the mattress assembly from a first position to a second position, wherein, in the second position, the pivot angle is a second pivot angle in a range from 30 degrees to 80 degrees, and wherein the leg angle is a second leg angle larger than 45 degrees.

15 Claims, 8 Drawing Sheets

(56) References Cited

U.S. PATENT DOCUMENTS

| | | | | |
|---|---|---|---|---|
| 2012/0151678 | A1* | 6/2012 | Richards | A61G 7/002 5/613 |
| 2013/0007960 | A1* | 1/2013 | Manouchehri | A61G 7/053 5/618 |
| 2013/0291305 | A1* | 11/2013 | Soltani | A61G 7/0509 5/618 |
| 2018/0014990 | A1* | 1/2018 | Stanislao | A61G 7/015 |
| 2018/0369049 | A1 | 12/2018 | Eskridge, III | |

* cited by examiner

BED SYSTEM AND RELATED METHOD

The present disclosure relates to a bed system and related method and in particular to a bed system with a bed frame and mattress assembly pivotably mounted on the bed frame.

BACKGROUND

Bed systems assisting a user in getting in and out of bed, e.g. by having a mattress assembly pivotably mounted on a bed frame are known.

Known bed systems require large space and/or may be tedious to operate with little flexibility in the operation thereof.

SUMMARY

Accordingly, there is a need for bed systems and methods of operating bed systems with reduced space requirements and/or with increased flexibility in the operation thereof.

A bed system is disclosed, the bed system comprising a bed frame and a mattress assembly pivotably mounted on the bed frame for pivoting the mattress assembly about a pivot axis to form a pivot angle between the mattress assembly and a longitudinal axis of the bed frame, the mattress assembly comprising a back part, a seat part and a leg part, wherein a back normal of the back part and the pivot axis forms a back angle, a seat normal of the seat part and the pivot axis forms a seat angle, and a leg normal of the leg part and the pivot axis forms a leg angle, the bed system comprising a controller device, wherein the controller device is configured to: move the mattress assembly from a first position to a second position. In the second position, the pivot angle is a second pivot angle optionally in a range from 30 degrees to 80 degrees, and/or wherein the leg angle is a second leg angle optionally larger than 45 degrees.

Further, a method of operating a bed system is provided, the bed system comprising a bed frame and a mattress assembly pivotably mounted on the bed frame for pivoting the mattress assembly about a pivot axis to form a pivot angle between the mattress assembly and a longitudinal axis of the bed frame, the mattress assembly comprising a back part, a seat part and a leg part, wherein a back normal of the back part and the pivot axis forms a back angle, a seat normal of the seat part and the pivot axis forms a seat angle, and a leg normal of the leg part and the pivot axis forms a leg angle, the method comprising moving the mattress assembly from a first position to a second position, wherein moving the mattress assembly from a first position to a second position comprises pivoting the mattress assembly optionally in a range from 30 degrees to 80 degrees about the pivot axis and tilting a leg part of the mattress assembly optionally at least 45 degrees.

It is an important advantage of the bed system and/or method that the bed system can be used or operated in tight spaces with little room on the side of the bed.

The present disclosure allows for improved control of the bed system and/or increased flexibility in operating the bed system with increased possibilities of customizing the operation of the bed system to personalized needs.

BRIEF DESCRIPTION OF THE DRAWINGS

The above and other features and advantages of the present invention will become readily apparent to those skilled in the art by the following detailed description of exemplary embodiments thereof with reference to the attached drawings, in which.

DETAILED DESCRIPTION

Figure 1:
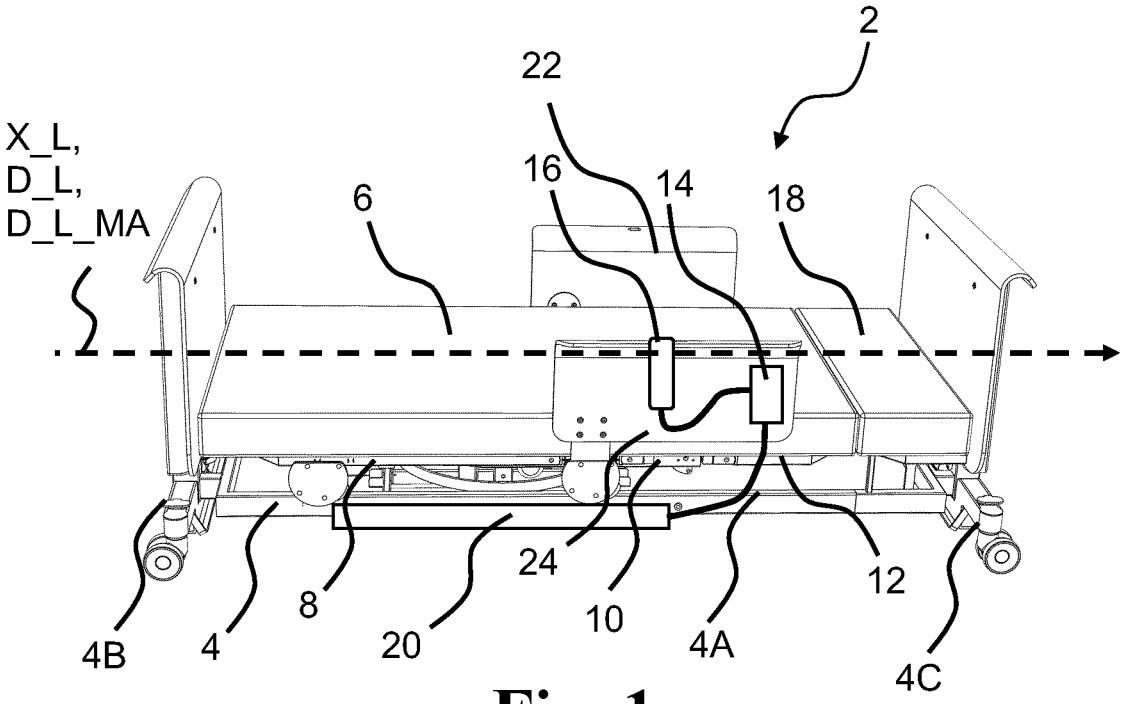
FIG. 1 is a perspective view of an exemplary bed system with a mattress assembly in a first position.

Various exemplary embodiments and details are described hereinafter, with reference to the figures when relevant. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The present disclosure relates to a bed system. The bed system comprises a bed frame and a mattress assembly pivotably mounted on the bed frame for pivoting the mattress assembly about a pivot axis to form a pivot angle between the mattress assembly and a longitudinal axis or longitudinal direction of the bed frame. The longitudinal axis of the bed frame may be defined as the intended lying position of the user. A longitudinal direction of the bed frame is intended to refer to a direction parallel to the longitudinal and from head to toe of a user in intended lying position.

The bed system comprises a controller device configured to control operation of the bed system according to user input from a user via a user interface. The controller device is an electronic controller device and comprises a processing unit, memory, and an interface. The memory of the controller device may have bed settings stored therein. The bed settings may comprise first position settings, also denoted PS_1, indicative of bed settings in a first position of the mattress assembly and second position settings, also denoted PS_2, indicative of bed settings in a second position of the mattress assembly. The bed settings may comprise third position settings, also denoted PS_3, indicative of bed settings in a third position of the mattress assembly. The bed settings may comprise intermediate position settings, also denoted PS_i, indicative of bed settings in intermediate position(s) of the mattress assembly. A position setting may include one or more of a pivot angle setting, a back angle setting, a seat angle setting and a leg angle setting. A position setting may include a height setting. The controller device is optionally configured to operate the bed system, e.g. move from a position (e.g. first position) to another position (e.g. second position), in accordance with or based on the position settings in the memory.

The controller device may be wirelessly connected/connectable to one or more external light sources/light controllers for control of the external light sources/light controllers (application of lighting schemes(s)) e.g. based on one or more of mattress assembly position, pivot angle, and user input indicative of a request to move the mattress assembly. Thus, external light sources/light controllers (not shown) may be controlled by the controller device based on one or more light criteria including a first light criterion and/or a second light criterion.

The bed frame comprises a frame part, a first end part, and a second end part. The bed frame has a bed frame width, also denoted W_BF, and the mattress assembly has a mattress assembly width, also denoted W_MA. In one or more exemplary systems, W_BF <0.8W_MA. A bed system with small bed frame width compared to mattress assembly width allows for increased design freedom in selecting bed settings, e.g. second pivot angle of second position and/or third pivot angle of third position.

The mattress assembly comprises a back part, wherein a back normal of the back part and the pivot axis forms a back angle.

The mattress assembly comprises a seat part, wherein a seat normal of the seat part and the pivot axis forms a seat angle. The seat part may be a two-part seat part comprising a primary seat part and a secondary seat part.

The mattress assembly comprises a leg part, wherein a leg normal of the leg part and the pivot axis forms a leg angle.

The bed system comprises one or more actuators for tilting parts, such as back part, seat part, leg part, of the mattress assembly in relation to each other, e.g. in response to control signals from the controller device. The bed system optionally comprises a back actuator for tilting the back part of the mattress assembly. The back actuator is controlled by a back control signal from the controller device. The bed system optionally comprises a leg actuator for tilting the leg part and/or seat part of the mattress assembly. The leg actuator is controlled by a leg control signal from the controller device. The bed system optionally comprises a pivot actuator for pivoting the mattress assembly about the pivot axis in relation to the bed frame. The pivot actuator is controlled by a pivot control signal from the controller device.

In the disclosed bed system, the controller device is configured to move the mattress assembly to a second position, e.g. from a first position and/or a third position. In the second position of the mattress assembly, the pivot angle is a second pivot angle, e.g. in a range from 30 degrees to 80 degrees. In one or more exemplary bed systems, the second pivot angle may be in the range from 80 to 100 degrees, e.g. about 90 degrees. In one or more exemplary bed systems, the second pivot angle may be in the range from 100 degrees to 135 degrees. In the second position of the mattress assembly, the leg angle is a second leg angle, e.g. larger than 45 degrees.

In one or more exemplary bed systems, the second pivot angle is in the range from 40 degrees to 75 degrees.

In one or more exemplary bed systems, the seat angle, in the second position of the mattress assembly, is a second seat angle less than 30 degrees. In one or more exemplary bed systems, the back angle, in the second position of the mattress assembly is a second back angle larger than 45 degrees, such as larger than 70 degrees. In one or more exemplary bed systems, the back angle, in the second position of the mattress assembly is a second back angle larger than 80 degrees or in a range from 80 degrees to 87 degrees, such as about 85 degrees.

The first position of the mattress assembly may be a lying position. In one or more exemplary bed systems, the back angle, in the first position of the mattress assembly is a first back angle less than 35 degrees, such as less than 20 degrees, e.g. 15 degrees, 10 degrees, 5 degrees, or even 0 degrees. In one or more exemplary bed systems, the seat angle, in the first position of the mattress assembly is a first seat angle less than 35 degrees, such as less than 20 degrees, e.g. 15 degrees, 10 degrees, 5 degrees, or even 0 degrees. In one or more exemplary bed systems, the leg angle, in the first position of the mattress assembly is a first leg angle less than 35 degrees, such as less than 20 degrees, e.g. 15 degrees, 10 degrees, 5 degrees, or even 0 degrees.

The first position of the mattress assembly may be a sitting position. In one or more exemplary bed systems, the back angle, in the first position of the mattress assembly is a first back angle larger than 65 degrees or in a range from 70 degrees to 87 degrees, such as about 75 degrees or about 85 degrees.

In one or more exemplary bed systems, the seat angle, in the third position of the mattress assembly, is a third seat angle less than 30 degrees. In one or more exemplary bed systems, the back angle, in the third position of the mattress assembly is a third back angle larger than 45 degrees, such as larger than 70 degrees. In one or more exemplary bed systems, the back angle, in the third position of the mattress assembly is a third back angle larger than 80 degrees or in a range from 80 degrees to 87 degrees, such as about 85 degrees. In one or more exemplary bed systems, the third back angle is different from the second back angle.

In one or more exemplary bed systems, in the second position of the mattress assembly, a primary part angle between the leg normal of the leg part and the seat normal of the seat part is a second primary part angle, e.g. larger than 90 degrees, such as larger than 95 degrees. A large second primary part angle facilitates exit and entry into the bed.

In one or more exemplary bed systems, in the second position of the mattress assembly, a secondary part angle between the back normal of the back part and the seat normal of the seat part is a second secondary part angle in the range from 45 degrees to 110 degrees.

In one or more exemplary bed systems, the controller device is configured to move the mattress assembly to a third position. In the third position, the pivot angle is a third pivot angle, e.g. in the range from 80 degrees to 150 degrees. The third pivot angle may be larger than 90 degrees. In the third position of the mattress assembly, the leg angle is a third leg angle, e.g. larger than 45 degrees.

In one or more exemplary bed systems, the controller device is configured to move the mattress assembly to the first position, e.g. from the second position and/or from the third position. The first position may be a lying or resting position. In the first position, the mattress assembly has not been pivoted, i.e. the pivot angle is a first pivot angle of 0 degrees. In other words, the mattress assembly, in the first position, is parallel to the longitudinal axis of the bed frame.

In one or more exemplary bed systems, the controller device is, in the second position and/or the third position of the mattress assembly, configured to receive an exit request via a user interface, and increase the back angle to an exit back angle and/or increase the height of the mattress assembly to an exit height in response to receiving the exit request. The exit back angle may be in the range from 85 degrees to 90 degrees, such as 88 degrees or 89 degrees. The exit height may be in the range from 55 cm to 85 cm. In other words, the controller device may be configured to move the mattress assembly to an exit position, e.g. from the second position and/or from the third position, e.g. in response to receiving an exit request via the user interface. Thus, a user can be assisted in getting to a standing position from the second position and/or the third position (sitting positions) by providing input via the user interface.

In one or more exemplary bed systems, to move the mattress assembly to the first position comprises reducing a primary part angle between the leg normal of the leg part and the seat normal of the seat part, and tilting the back part. To move the mattress assembly to the first position optionally comprises determining if a first primary criterion is satisfied; and in accordance with a determination that the first primary criterion is satisfied, tilting the back part, e.g. by reducing the back angle. In other words, tilting the back part may be conditional on the satisfaction of a first primary criterion. The first primary criterion may be based on the leg angle and/or the primary part angle. The first primary criterion may be satisfied, when the leg angle is less than a leg threshold, such as 75 degrees. Thus, back part tilt may be delayed compared to leg part tilt to create a smoother transition to the first position for the user.

In one or more exemplary bed systems, the controller device is configured to move the mattress assembly to the first position, wherein to move the mattress assembly to the first position comprises moving the mattress assembly to a pivoted intermediate position; pivoting the mattress assembly to a non-pivoted intermediate position; and moving the mattress assembly from the non-pivoted intermediate position to the first position.

In one or more exemplary bed systems, the controller device is configured to move the mattress assembly to one or more intermediate positions, such as a pivoted intermediate position and/or a non-pivoted intermediate position. In the intermediate position(s), such as the pivoted intermediate position and/or the non-pivoted intermediate position, the back angle is an intermediate back angle, e.g. in the range from 35 to 65 degrees, e.g. in accordance with or based on position settings in the memory. In the intermediate position, such as the pivoted intermediate position and/or the non-pivoted intermediate position, the seat angle is an intermediate seat angle, e.g. less than 35 degrees, e.g. in accordance with or based on position settings in the memory. The intermediate seat angle may be in the range from 3 degrees to 35 degrees. A slightly tilted seat angle ensures that the user does not slide down, when the back angle is increased. In the intermediate position, such as the pivoted intermediate position and/or the non-pivoted intermediate position, the leg angle is an intermediate leg angle, e.g. less than 35 degrees, e.g. in accordance with or based on position settings in the memory. The intermediate leg angle angle may be less than 20 degrees, e.g. in the range from 3 degrees to 15 degrees or 0 degrees.

In one or more exemplary bed systems, to move the mattress assembly from the first position to the second position comprises moving the mattress assembly to a non-pivoted intermediate position; pivoting the mattress assembly to a pivoted intermediate position; and moving the mattress assembly from the pivoted intermediate position to the second position, e.g. in accordance with or based on the position settings in the memory.

In one or more exemplary bed systems, the controller may be configured to move the mattress assembly from the second position to the third position, wherein to move the mattress assembly from the second position to the third position comprises pivoting the mattress assembly to the third position, e.g. in accordance with or based on the third position settings in the memory.

In one or more exemplary bed systems, to move the mattress assembly to the second position comprises moving the mattress assembly to a second height, e.g. in accordance with a second height setting of second position settings stored in the memory.

In one or more exemplary bed systems, to move the mattress assembly to the non-pivoted intermediate position comprises moving the mattress assembly to an intermediate height, e.g. in accordance with an intermediate height setting of intermediate position settings stored in the memory.

In one or more exemplary bed systems, the controller is configured to receive a storing request via a user interface, and store one or more bed settings in accordance with the storing request. To store one or more bed settings in accordance with the storing request may comprise obtaining a current bed setting, determining if the current bed setting satisfies a bed setting criterion, and in accordance with the current bed setting satisfying the bed setting criterion, storing the current bed setting as bed setting (position settings) in the memory. Thereby, a failsafe update of bed settings is provided. The bed setting may be or comprise a height of the mattress assembly. The bed setting may be or comprise a back angle. The bed setting may be or comprise a pivot angle.

The storing request may comprise a first storing request indicative of a back angle setting of an intermediate position e.g. pivoted and/or non-pivoted intermediate position. To store one or more bed settings in accordance with the storing request may comprise obtaining a current back angle, determining if the current back angle satisfies a back angle criterion, and, in accordance with the current back angle satisfying the back angle criterion, storing the current back angle as a back angle setting of a position setting, e.g. as back angle setting of the intermediate position (intermediate back angle setting). In accordance with the current back angle not satisfying the back angle criterion, the first storing request may be ignored and the current back angle is not stored in the memory. Thus, a user is allowed to adjust the back angle of the intermediate position and optionally to adjust the back angle of the intermediate position in a failsafe manner in order to avoid storing of bed settings that e.g. would be damaging to the bed system during operation.

In one or more exemplary bed systems, the back angle criterion is satisfied if the current back angle is within an angle range, e.g. between 35 degrees and 65 degrees. In one or more exemplary bed systems, the back angle criterion is satisfied if the current back angle is larger than an angle threshold, e.g. larger than 35 degrees.

The storing request may comprise a second storing request indicative of a height setting of a second position and/or a third position of the mattress assembly. To store one or more bed settings in accordance with the storing request may comprise obtaining a current height of the mattress assembly, determining if the current height satisfies a height criterion, and, in accordance with the current height satisfying the height criterion, storing the current height as height setting of the second position (second height setting) and/or the third position (third height setting). To store one or more bed settings in accordance with the storing request may comprise obtaining a current height of the mattress assembly, determining if the current height satisfies a height criterion, and, in accordance with the current height satisfying the height criterion, storing the current height as an intermediate height setting of intermediate position(s). In accordance with the current height not satisfying the height criterion, the second storing request may be ignored and the current height is not stored in the memory. Thus, a user is allowed to adjust the height of the second position and/or the third position and optionally to adjust the height setting in a failsafe manner in order to avoid storing of bed settings that e.g. would not suit or be dangerous to the user (e.g. due to risk of a user falling out of bed). In one or more exemplary bed systems, the height criterion is satisfied if the current height is less than a height threshold, e.g. less than 52 cm. In one or more exemplary bed systems, the height criterion is satisfied if the current height is within a height range, e.g. between 32 cm and 52 cm.

The storing request may comprise a third storing request indicative of a pivot angle setting of a second position and/or a third position. To store one or more bed settings in accordance with the storing request may comprise obtaining a current pivot angle of the mattress assembly, determining if the current pivot angle satisfies a pivot angle criterion, and, in accordance with the current pivot angle satisfying the pivot angle criterion, storing the current pivot angle as pivot angle setting of the second position and/or the third position. Thus, a user is allowed to adjust the pivot angle of the second position and/or the third position and optionally to adjust the pivot angle setting in a failsafe manner in order to avoid storing of bed settings that e.g. would be damaging to the bed system during operation. In one or more exemplary bed systems, the pivot angle criterion is satisfied if the pivot angle is within an angle range, e.g. between 45 degrees and 135 degrees or between.

The storing request may comprise a reset request and to store one or more bed settings in accordance with the storing request may comprise storing factory settings as bed settings in accordance with the reset request.

In one or more exemplary bed systems, the bed system comprises a light assembly, and wherein to move the mattress assembly from the first position to the second position comprises increasing the pivot angle; determining if a first light criterion is satisfied; and in accordance with a determination that the first light criterion is satisfied, turning on the light assembly and/or applying a first lighting scheme. The first light criterion may be based on the pivot angle. For example, the first light criterion may be satisfied if the pivot angle is larger than a threshold, e.g. 0 degrees, 5 degrees, or 45 degrees. The first light criterion may be based on user input indicative of a request to move the mattress assembly to the second position and/or the third position. Thereby, turning on the light assembly may be linked to moving the mattress assembly to the second position and/or the third position reducing the number of user inputs. Thus, the controller device may be configured to control the light assembly, e.g. based on one or more of mattress assembly position, the pivot angle and/or be based on user input indicative of a request to move the mattress assembly, e.g. to one of the first position, the second position and/or the third position. For example, the controller device may be configured to turn on the light assembly and/or apply first lighting scheme when a user indicates by his user input that the mattress assembly is to move, e.g. to the second position and/or the third position. The light assembly may be turned on in the beginning (e.g. at start of), during or at the end of the transition between different positions, such as from the first position to the second position and/or the third position. In one or more exemplary bed systems, the controller device may be configured to turn on the light/apply first lighting scheme when the pivot angle increases above a threshold, such as above a threshold of 0 degrees or in the range from 0 to 45 degrees. The controller device is optionally configured to transmit light control signal(s) to the light assembly and/or to external light sources/light controllers. In other words, the controller device may be configured to transmit, e.g. wirelessly transmit, light control signal(s) to the light assembly and/or to external light sources/light controllers for controlling the light assembly/external light sources to operate according to different lighting schemes. Thus, the first lighting scheme may be applied to the light assembly/external light sources when the mattress assembly is in the second position and/or the third position. In one or more exemplary bed systems, the controller device is configured to transmit by wire light control signals to the light assembly and optionally wirelessly transmit light control signals to external light sources/light controllers, e.g. to apply a lighting scheme in the light assembly and/or external light sources.

In one or more exemplary bed systems, to move the mattress assembly, e.g. to move the mattress assembly to the first position, comprises decreasing the pivot angle; determining if a second light criterion is satisfied; and in accordance with a determination that the second light criterion is satisfied, turning off the light assembly and/or applying a second lighting scheme. The second light criterion may be based on the pivot angle. For example, the second light criterion may be satisfied or at least partly satisfied if the pivot angle is 0 degrees (e.g. partly corresponding to a lying position) or less than a threshold, e.g. less than 45 degrees. The second light criterion may be based on user input indicative of a request to move the mattress assembly to the first position. Thereby, turning off the light assembly/applying second lighting scheme may be linked to moving the mattress assembly to the first position reducing the number of user inputs. The first lighting scheme may be characterized in that the light assembly/external light sources has a first light intensity. In other words, the light assembly/external light sources emit light with a first light intensity when the first lighting scheme is applied. The second lighting scheme may be characterized in that the light assembly/external light sources has a second light intensity. In other words, the light assembly/external light sources emit light with a second light intensity when the second lighting scheme is applied. The first lighting scheme may be different from the second lighting scheme. The first light intensity may be larger than the second light intensity. The second light intensity may be zero corresponding to light being turned off. The second light intensity may be less than a threshold. In other words, the second lighting scheme may correspond to a night/sleeping scenario. The second lighting scheme may be applied to the light assembly/external light sources when the mattress assembly is in the first position.

Further, the present disclosure relates to a method of operating a bed system, e.g. a bed system as disclosed herein, the bed system comprising a bed frame and a mattress assembly pivotably mounted on the bed frame for pivoting the mattress assembly about a pivot axis to form a pivot angle between the mattress assembly and a longitudinal axis of the bed frame, the mattress assembly comprising a back part, a seat part and a leg part, wherein a back normal of the back part and the pivot axis forms a back angle, a seat normal of the seat part and the pivot axis forms a seat angle, and a leg normal of the leg part and the pivot axis forms a leg angle. The method comprises moving the mattress assembly from a first position to a second position, wherein moving the mattress assembly from a first position to a second position comprises pivoting the mattress assembly e.g. in a range from 30 degrees to 80 degrees about the pivot axis and tilting a leg part of the mattress assembly, e.g. at least 45 degrees.

In one or more exemplary methods, the method comprises receiving a storing request via a user interface, and storing one or more bed settings in accordance with the storing request.

In one or more exemplary methods, the method comprises moving the mattress assembly to the first position, e.g. from the second position or a third position of the mattress assembly. Moving the mattress assembly to the first position optionally comprises reducing a primary part angle between the leg normal of the leg part and the seat normal of the seat part; determining if a first primary criterion is satisfied; and in accordance with a determination that the first primary criterion is satisfied, tilting the back part. In other words, tilting the back part may be conditional on the satisfaction of a first primary criterion. The first primary criterion may be based on the leg angle and/or the primary part angle. The first primary criterion may be satisfied, when the leg angle is less than a leg threshold, such as 75 degrees. Thus, back part tilt may be delayed compared to leg part tilt to create a smoother transition to the first position for the user.

In one or more exemplary methods, the method comprises moving the mattress assembly to the first position, wherein moving the mattress assembly to the first position comprises moving the mattress assembly to a pivoted intermediate position; pivoting the mattress assembly to a non-pivoted intermediate position; and moving the mattress assembly from the non-pivoted intermediate position to the first position.

FIG. 1 shows an exemplary bed system. The bed system 2 comprises a bed frame 4 and a mattress assembly 6 pivotably mounted on the bed frame 4 for pivoting the mattress assembly 6 about a pivot axis to form a pivot angle between the mattress assembly and a longitudinal axis X_L or longitudinal direction D_L of the bed frame. The longitudinal direction D_L of the bed frame refers to a direction parallel to the longitudinal axis X_L and from head to toe of a user in intended lying position. The mattress assembly 6 comprises a back part 8, a seat part 10, and a leg part 12. The bed system 2 comprises a controller device 14 configured to control operation of the bed system 2 according to user input from a user via a user interface 16. The user interface 16 is optionally embedded in a wireless remote control wirelessly communicating with the controller device 14. The controller device 14 is an electronic controller device and comprises a processing unit, memory, and an interface, see FIG. 11. The controller device 14 is connected to one or more actuators for control of one or more control actuators. The one or more actuators include a pivot actuator for pivoting the mattress assembly 6 about pivot axis, a back actuator for tilting the back part 8, and a leg actuator for tilting the seat part 10 and/or the leg part 12. The bed system optionally 2 comprises a foot part 18. The foot part 18 may be fixedly mounted on the bed frame 4 and optionally form a part of a lying surface together with the mattress assembly 6.

The bed frame 4 comprises a frame part 4A, a first end part 4B, and a second end part 4C. The height of the frame part 4A (and therefore also the height of the mattress assembly 6 mounted to frame part 4A may be adjusted in relation to the first end part 4B, and the second end part 4C by one or more height actuators (not shown), e.g. in accordance with or based on height settings in the memory.

Optionally, the bed system 2 comprises a light assembly 20 connected to the controller device 14 for control of the light assembly 20, e.g. based on one or more light criteria including a first light criterion and/or a second light criterion. The controller device 14 may be wirelessly connected to one or more external light sources/light controllers (not shown) for control of the external light/light controllers (application of lighting schemes(s)) e.g. based on one or more of mattress assembly position, pivot angle, and user input indicative of a request to move the mattress assembly. Thus, external light sources/light controllers (not shown) may be controlled by the controller device based on one or more light criteria including a first light criterion and/or a second light criterion.

The bed system 2 optionally comprises a first (left) bed rail 22 and a second (right) bed rail 24.

Figure 2:
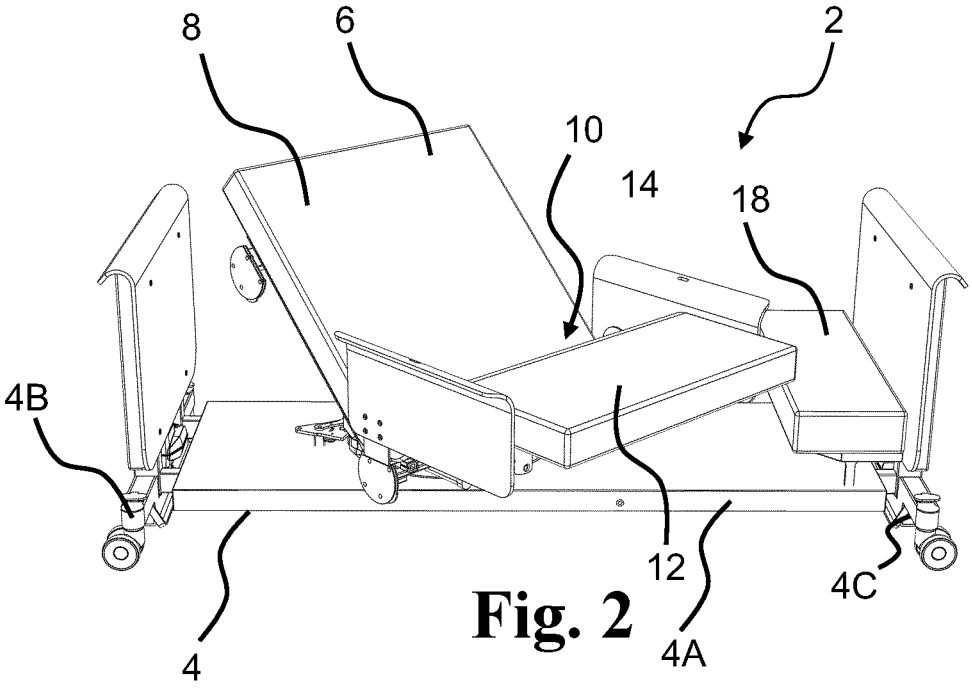
FIG. 2 is a perspective view of an exemplary bed system with a mattress assembly in a pivoted intermediate position.

FIG. 2 is a perspective view of the bed system 2 with the mattress assembly 6 in a pivoted intermediate position. The mattress assembly 6 has been pivoted at least 45 degrees about the pivot axis from a non-pivoted intermediate position (where the mattress assembly is parallel to the longitudinal direction X_L of the bed frame 4 by the controller device controller sending a pivot control signal to the pivot actuator. In the pivoted intermediate position, the back part 8 and the seat part 10 have been tilted to form respective back angle and seat angle in accordance with or based on the position settings in the memory of the controller device 14.

Figure 3:
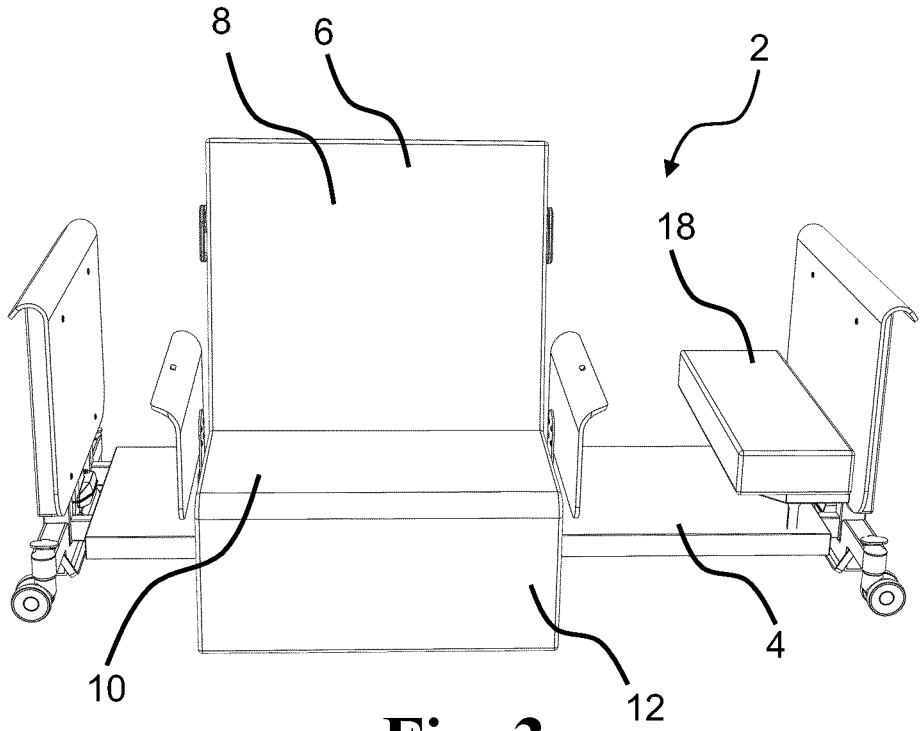
FIG. 3 is a perspective view of an exemplary bed system with a mattress assembly in a third position.

FIG. 3 is a perspective view of an exemplary bed system with a mattress assembly in an exemplary third position. The mattress assembly has been pivoted to a pivot angle of 90 degrees. In other words, the mattress assembly 6 is perpendicular to the (longitudinal axis of) bed frame 4. The back part 8 and the leg part 12 have been tilted to form respective third back angle and third seat angle in accordance with or based on the third position settings in the memory of the controller device 14.

Figure 4:
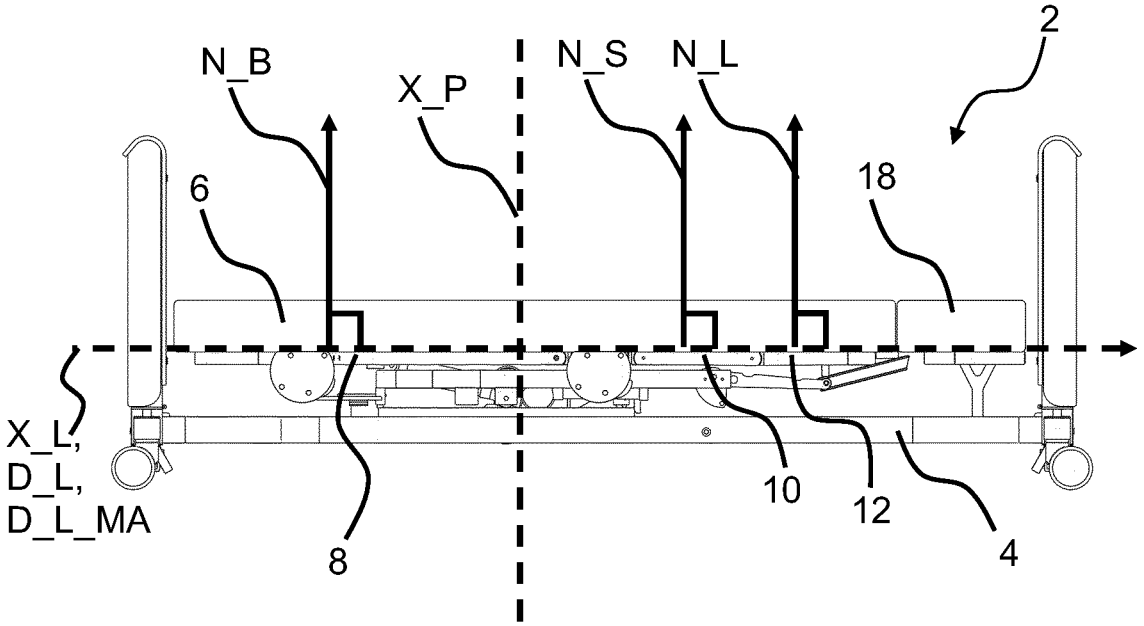
FIG. 4 is a side view of an exemplary bed system with a mattress assembly in a first position.
Figure 5:
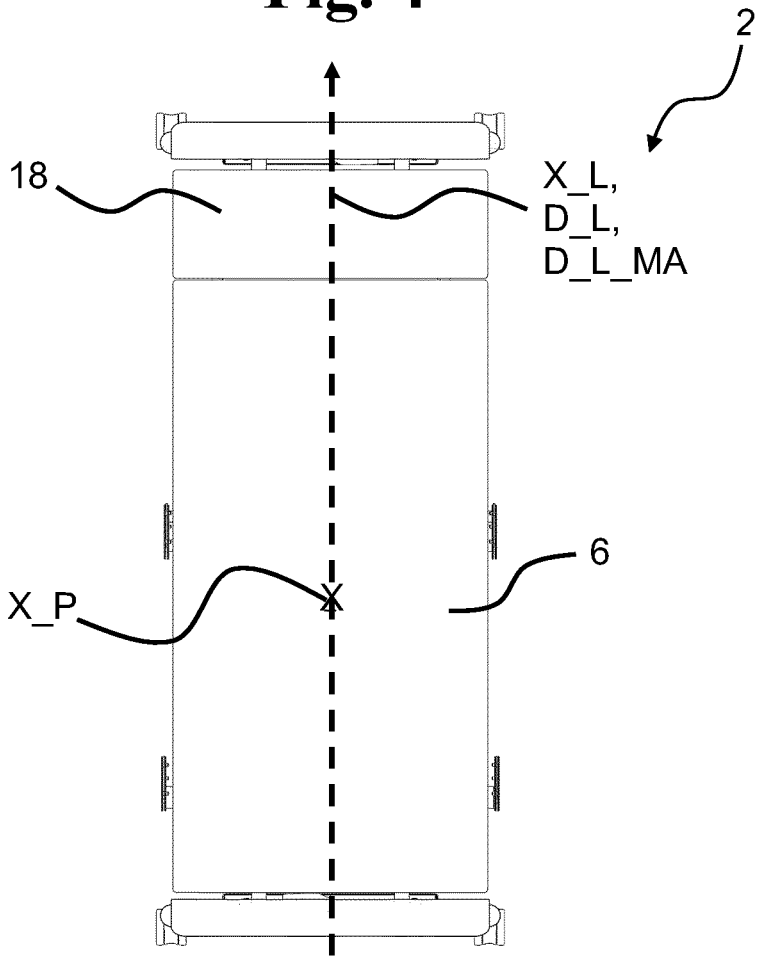
FIG. 5 is a top view of an exemplary bed system with a mattress assembly in a first position.

FIG. 4 and FIG. 5 are respective side view and top view of the bed system 2 with the mattress assembly 6 in a first position. The back part 8 has a back normal N_B forming a back angle V_B with the pivot axis X_P. The seat part 10 has a seat normal N_S forming a seat angle V_S with the pivot axis X_P. The leg part 12 has a leg normal N_L leg forming a leg angle C_L with the pivot axis X_P.

In the illustrated first position, the back angle V_B is a first back angle of 0 degrees, the seat angle V_S is a first seat angle of 0 degrees, and the leg angle V_L is a first leg angle of 0 degrees, i.e. the back part, the seat part and the leg part form a flat lying surface.

Exemplary angle settings (in degrees) for first back angle V_B_1, first seat angle V_S_1, and first leg angle V_L_1 of exemplary first positions A1, B1, C1, D1, E1, F1, G1, and H1 of a bed system are set out in the following table.

TABLE 1

| | Exemplary first positions | | | | | | | |
|---|---|---|---|---|---|---|---|---|
| | A1 | B1 | C1 | D1 | E1 | F1 | G1 | H1 |
| V_B_1 | 0 | 0-20 | >65 | >70 | <35 | 45 | 35-65 | 85 |
| V_S_1 | 0 | 0-45 | 0-45 | 0-45 | 30-40 | 30-40 | 35 | 30-40 |
| V_L_1 | 0 | 0-20 | 0-20 | <10 | <10 | <10 | 0 | <10 |

Figure 6:
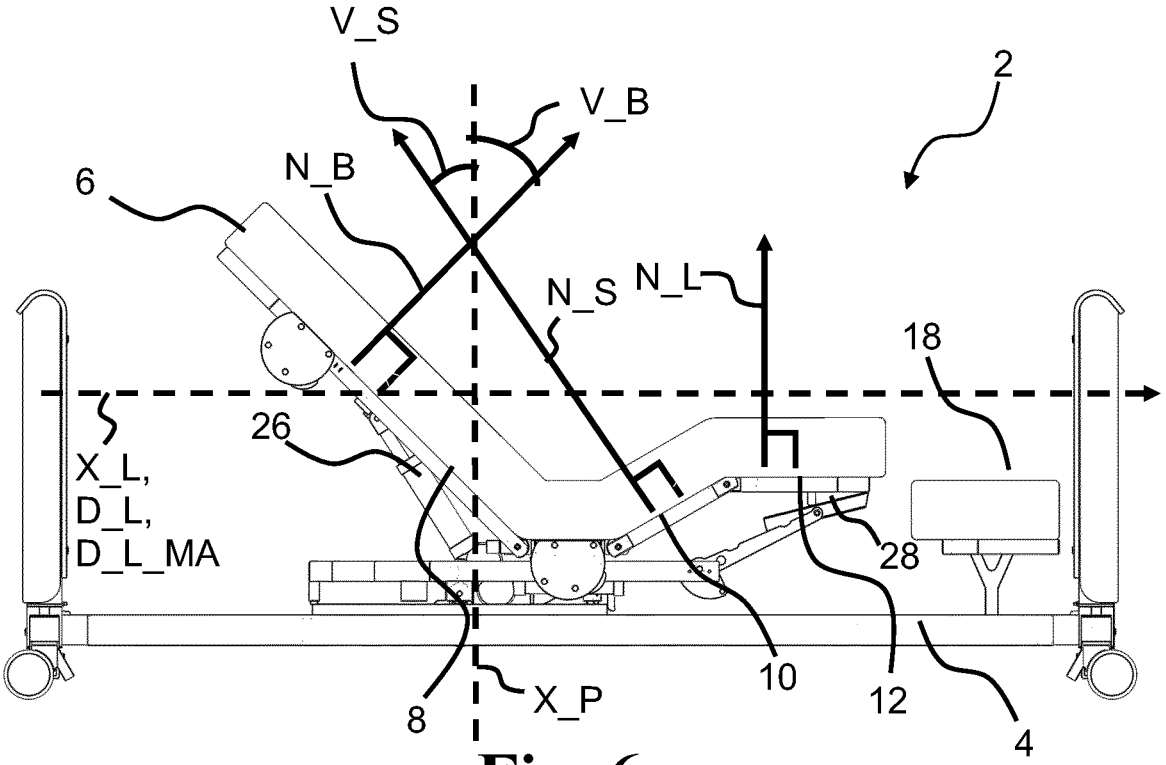
FIG. 6 is a side view of an exemplary bed system with a mattress assembly in a non-pivoted intermediate position.

FIG. 6 is a side view of bed system 2 with mattress assembly 6 in a non-pivoted intermediate position, where the pivot angle is 0 degrees, the back angle V_B is an intermediate back angle of 35-65 degrees, such as 45 degrees, e.g. in accordance with or based on position settings in the memory of the controller device 14, the seat angle V_S is an intermediate seat angle of 30-40 degrees, e.g. in accordance with or based on position settings in the memory of the controller device 14, and the leg angle is an intermediate leg angle less than 10 degrees, such as 0 degrees, e.g. in accordance with or based on position settings in the memory of the controller device 14.

The bed system 2 comprises one or more actuators for tilting parts, such as back part 8, seat part 10, and leg part 12, of the mattress assembly 6 in relation to each other, e.g. in response to control signals from the controller device. The bed system 2 comprises a back actuator 26 for tilting the back part 8. The back actuator 26 is connected to the controller device 14 and is controlled by a back control signal from the controller device 14. The bed system 2 comprises a leg actuator 28 for tilting the leg part 12 and the seat part 10 of the mattress assembly 6. The leg actuator 28 is connected to the controller device 14 and is controlled by a leg control signal from the controller device 14. The bed system 2 comprises a pivot actuator (not shown) for pivoting the mattress assembly 6 about the pivot axis X_P in relation to the bed frame 4 e.g. in accordance with or based on position settings in the memory of the controller device 14. The pivot actuator is connected to the controller device 14 and is controlled a pivot control signal from the controller device 14.

Exemplary angle settings (in degrees) for intermediate back angle V_B_i, intermediate seat angle V_S_i, and intermediate leg angle V_L_i of exemplary (pivoted and/or non-pivoted) intermediate positions Ai, Bi, Ci, Di of a bed system are set out in the following table.

TABLE 2

| Exemplary intermediate positions | | | | |
|---|---|---|---|---|
| | Ai | Bi | Ci | Di |
| V_B_i | 35-65 | 40-50 | >35 | 45 |
| V_S_i | 30-40 | 10-45 | 0-45 | 35 |
| V_L_i | <10 | 0-20 | 0-20 | 0 |

Figure 7:
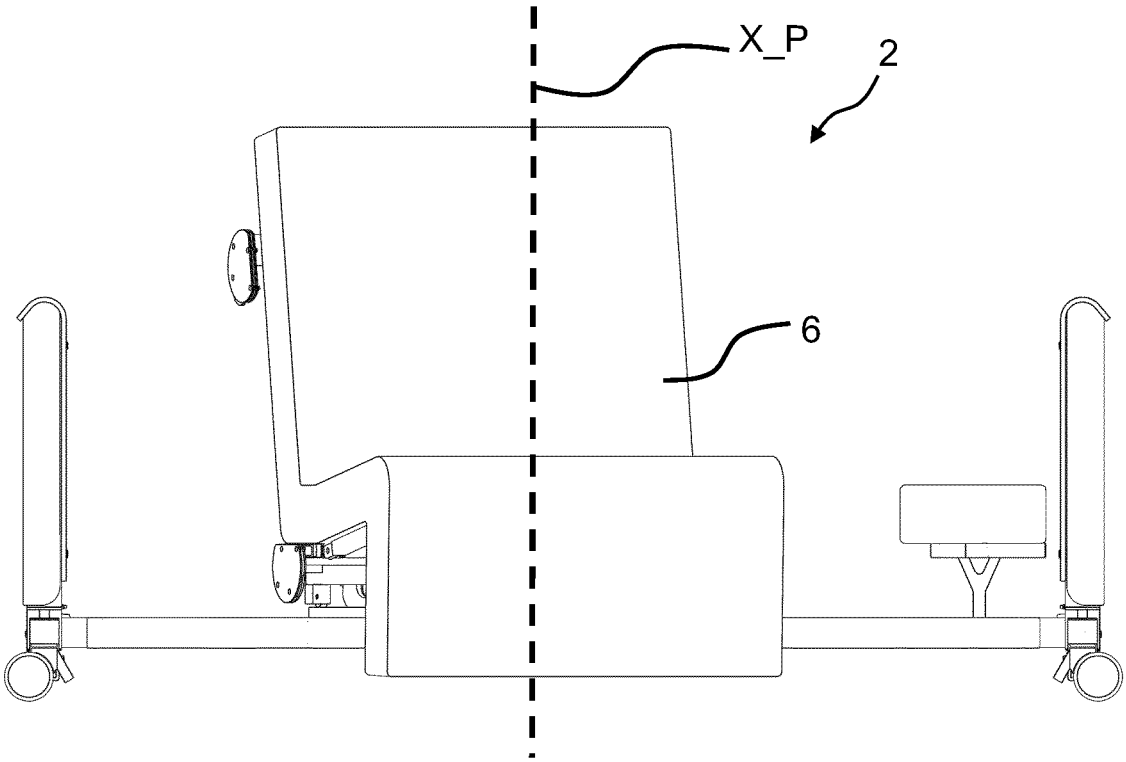
FIG. 7 is a side view of an exemplary bed system with a mattress assembly in a second position.
Figure 8:
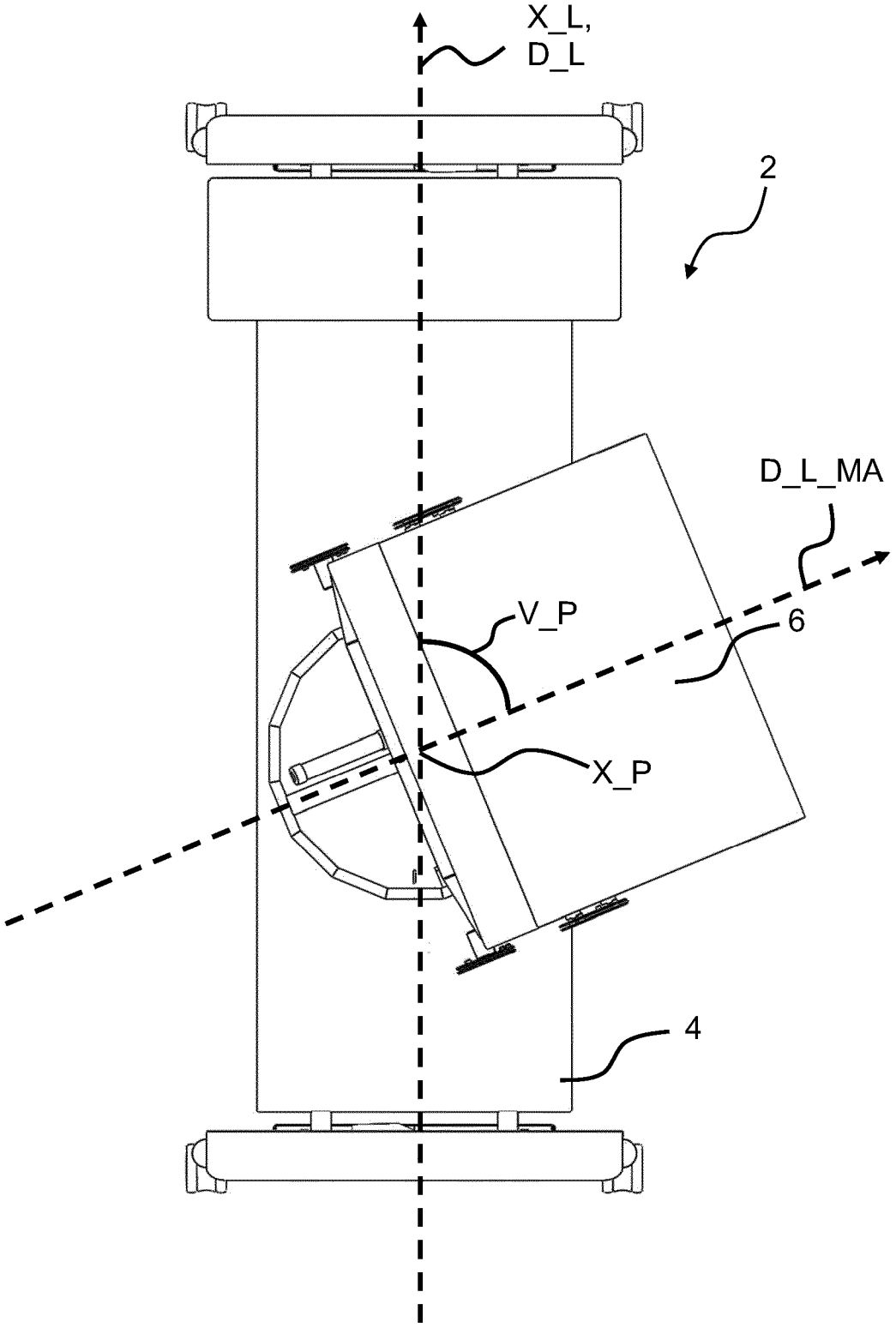
FIG. 8 is a top view of an exemplary bed system with the mattress assembly in a second position.
Figure 9:
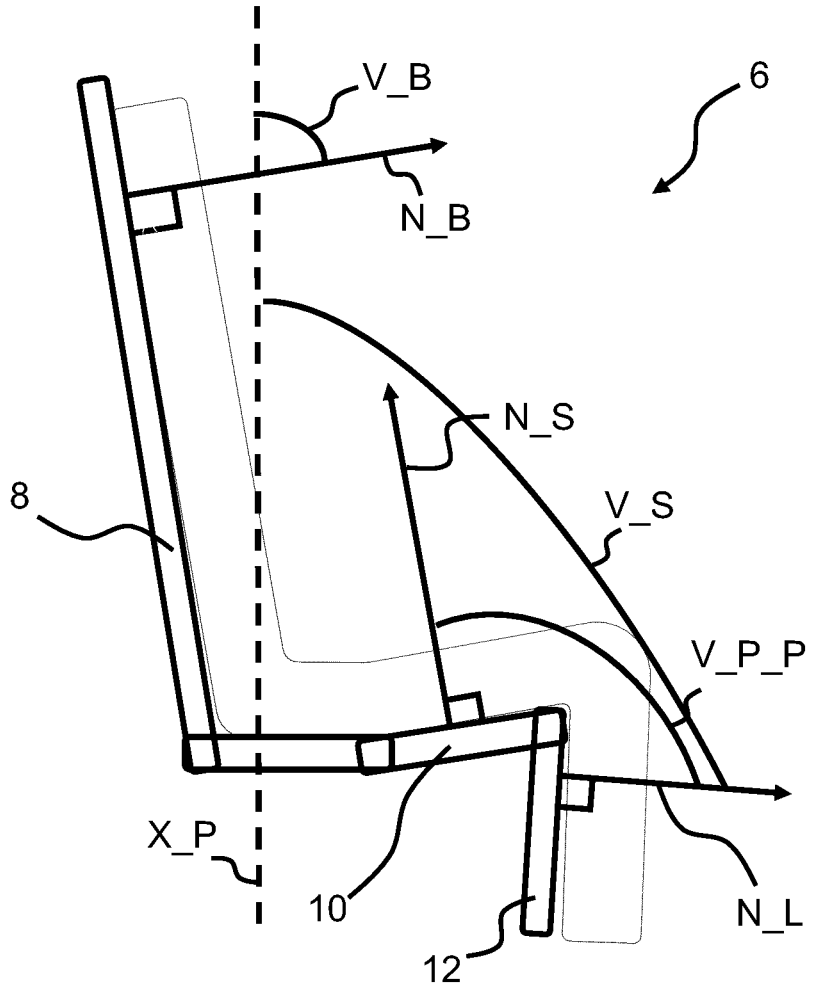
FIG. 9 is a side view of a mattress assembly in a second position.

FIG. 7 and FIG. 8 are respective side view and top view of the bed system 2 with the mattress assembly 6 in a second position, and FIG. 9 is a side view of the mattress assembly 6 in second position. In the illustrated second position, the back angle V_B is a second back angle of 75-88 degrees, e.g. 85 degrees, the seat angle V_S is a second seat angle less than 15 degrees, and the leg angle V_L is a second leg angle larger than 90 degrees. A primary part angle V_P_P between the leg normal N_L of the leg part 12 and the seat normal N_S of the seat part 10 is a second primary part angle larger than 90 degrees facilitating exit and entry into the bed. The pivot angle V_P (between longitudinal direction D_L of bed frame and longitudinal direction of mattress assembly D_L_MA) is a second pivot angle in the range from 30-80 degrees.

Exemplary angle settings (in degrees) for second back angle V_B_2, second seat angle V_S_2, second leg angle V_L_2, and second pivot angle V_P_2, of exemplary second positions A2, B2, C2, and D2 of a bed system are set out in the following table.

TABLE 3

| Exemplary second positions | | | | |
|---|---|---|---|---|
| | A2 | B2 | C2 | D2 |
| V_B_2 | 85 | 75-90 | >65 | >80 |
| V_S_2 | <10 | <15 | 0-45 | 0-45 |
| V_L_2 | >75 | >75 | >45 | >45 |
| V_P_2 | 30-80 | 50-75 | <80 | 30-80 |

In bed system 2, the controller device 14 is configured to move the mattress assembly to a second position, e.g. one of second positions A2, B2, C2, and D2, from a first position, e.g. one of first positions A1, B1, C1, D1, E1, F1, G1, an H1, and/or from a third position in accordance with or based on position settings in the memory of the controller device 14.

In the second position of the mattress assembly 6, the pivot angle V_P may be a second pivot angle V_P_2 in accordance with or based on position settings (second pivot angle setting) in the memory of the controller device 14.

The controller device 14 is configured to move the mattress assembly to the first position from the second position and/or from the third position via pivoted intermediate position and non-pivoted intermediate position.

Optionally, the controller device 14 is, in the second position and/or the third position of the mattress assembly, configured to receive an exit request via a user interface, such as via a single-touch input on the user interface, and increase the back angle V_B to an exit back angle and/or increase the height of the mattress assembly to an exit height in response to receiving the exit request. The exit back angle may be in the range from 85 degrees to 90 degrees, such as 88 degrees or 89 degrees. The exit height may be in the range from 55 cm to 85 cm. In other words, the controller device may be configured to move the mattress assembly to an exit position, e.g. from the second position and/or from the third position, e.g. in response to receiving an exit request via the user interface. Thus, a user can be assisted in getting to a standing position from the second position and/or the third position (sitting positions) by providing input, such as a single-touch input, via the user interface 16.

The controller device 14 is configured to move the mattress assembly 6 to the first position, e.g. in response to receiving a first position request via user interface 16, wherein to move the mattress assembly 6 to the first position optionally comprises moving the mattress assembly to a pivoted intermediate position including tilting one or more of the back part, the seat part and the leg part optionally in accordance with or based on intermediate position settings in the memory; pivoting the mattress assembly 6 to a non-pivoted intermediate position (where the mattress assembly is parallel to the longitudinal axis of the bed frame, i.e. the pivot angle is zero); and moving the mattress assembly from the non-pivoted intermediate position to the first position optionally in accordance with or based on first position settings in the memory. To move the mattress assembly 6 to the first position optionally comprises decreasing the pivot angle; determining if a second light criterion is satisfied; and in accordance with a determination that the second light criterion is satisfied, turning off the light assembly 20/applying a second lighting scheme. In other words, the controller device 14 may be configured to decrease the pivot angle; determine if a second light criterion is satisfied; and in accordance with a determination that the second light criterion is satisfied, turn off the light assembly 20/apply a second lighting scheme.

The controller device 14 is configured to move the mattress assembly 6 from the first position to the second position, e.g. in response to receiving a second position request via user interface 16, by moving the mattress assembly 6 to a non-pivoted intermediate position including tilting one or more of the back part, the seat part and the leg part optionally in accordance with or based on intermediate position settings in the memory. In bed system 2, to move the mattress assembly 6 to the non-pivoted intermediate position optionally comprises moving the mattress assembly to an intermediate height, e.g. in accordance with an intermediate height setting of intermediate position settings stored in the memory. The controller device 14 is configured to pivoting the mattress assembly to a pivoted intermediate position optionally in accordance with or based on intermediate position settings (intermediate pivot angle setting) in the memory; and moving the mattress assembly from the pivoted intermediate position to the second position optionally in accordance with or based on second position settings in the memory. In bed system 2, to move the mattress assembly 6 to the second position optionally comprises moving the mattress assembly to a second height, e.g. in accordance with a second height setting of second position settings stored in the memory.

In bed system 2, to move the mattress assembly from the first position to the second position optionally comprises increasing the pivot angle; determining if a first light criterion is satisfied; and in accordance with a determination that the first light criterion is satisfied, turning on the light assembly 20/applying a first lighting scheme. In other words, the controller device 14 may be configured to increase the pivot angle; determine if a first light criterion is satisfied; and in accordance with a determination that the first light criterion is satisfied, turn on the light assembly 20/apply a first lighting scheme.

The first light criterion may be based on the pivot angle. For example, the first light criterion may be satisfied if the pivot angle is larger than a threshold, e.g. 45 degrees. The first light criterion may be based on user input indicative of a request to move the mattress assembly to the second position and/or the third position. Thereby, turning on the light assembly is linked to moving the mattress assembly to the second position and/or the third position reducing the number of user inputs. In one or more exemplary bed systems, to apply the first lighting scheme comprises turning on and/or increasing light intensity of one or more external light sources for example by controlling the external light sources directly or via one or more light controllers. In one or more exemplary bed systems, to apply the first lighting scheme comprises turning on and/or increasing light intensity of the light assembly for example by wired control of the light assembly.

The second light criterion may be based on the pivot angle. For example, the second light criterion may be satisfied if the pivot angle is less than a threshold, e.g. 45 degrees. The second light criterion may be based on user input indicative of a request to move the mattress assembly to the first position. Thereby, turning off the light assembly/applying second lighting scheme is optionally linked to moving the mattress assembly to the first position reducing the number of user inputs. In one or more exemplary bed systems, to apply the second lighting scheme comprises turning off and/or decreasing light intensity of one or more external light sources for example by controlling the external light sources directly or via one or more light controllers. In one or more exemplary bed systems, to apply the second lighting scheme comprises turning off and/or decreasing light intensity of the light assembly for example by wired control of the light assembly.

Optionally, the controller device 14 is configured to receive a storing request via user interface 16, and store one or more bed settings in the memory in accordance with the storing request. To store one or more bed settings in accordance with the storing request may comprise obtaining a current bed setting, determining if the current bed setting satisfies a bed setting criterion, and in accordance with the current bed setting satisfying the bed setting criterion, storing the current bed setting as bed setting (position setting) in the memory. Thereby, a failsafe update of bed settings is provided. The bed setting may comprise a height of the mattress assembly. The bed setting may comprise a back angle. The bed setting may comprise a pivot angle.

The storing request may comprise a first storing request indicative of a back angle setting of an intermediate position e.g. pivoted and/or non-pivoted intermediate position. To store one or more bed settings in accordance with the storing request may comprise obtaining a current back angle, determining if the current back angle satisfies a back angle criterion, and, in accordance with the current back angle satisfying the back angle criterion, storing the current back angle as a back angle setting of a position setting, e.g. as back angle setting of the intermediate position (intermediate back angle setting). In accordance with the current back angle not satisfying the back angle criterion, the first storing request may be ignored and the current back angle is not stored in the memory. Thus, a user is allowed to adjust the back angle of the intermediate position and optionally to adjust the back angle of the intermediate position in a failsafe manner in order to avoid storing of bed settings that e.g. would be damaging to the bed system during operation.

In one or more exemplary bed systems, the back angle criterion is satisfied if the current back angle is within an angle range, e.g. between 35 degrees and 65 degrees. In one or more exemplary bed systems, the back angle criterion is satisfied if the current back angle is larger than an angle threshold, e.g. larger than 35 degrees.

The storing request may comprise a second storing request indicative of a height setting of a second position and/or a third position of the mattress assembly. The second storing request may be indicative of an intermediate height setting of an intermediate position. To store one or more bed settings in accordance with the storing request may comprise obtaining a current height of the mattress assembly, determining if the current height satisfies a height criterion, and, in accordance with the current height satisfying the height criterion, storing the current height as a second height setting of the second position and/or as a third height setting of the third position. To store one or more bed settings in accordance with the storing request may comprise obtaining a current height of the mattress assembly, determining if the current height satisfies a height criterion, and, in accordance with the current height satisfying the height criterion, storing the current height as an intermediate height setting of intermediate position(s). In accordance with the current height not satisfying the height criterion, the second storing request may be ignored and the current height is not stored in the memory. Thus, a user is allowed to adjust the height of one or more of intermediate position(s), the second position and the third position and optionally to adjust the height setting in a failsafe manner in order to avoid storing of bed settings that e.g. would not suit or be dangerous to the user (e.g. due to risk of a user falling out of bed). In one or more exemplary bed systems, the height criterion is satisfied if the current height is less than a height threshold, e.g. less than 52 cm. In one or more exemplary bed systems, the height criterion is satisfied if the current height is within a height range, e.g. between 32 cm and 52 cm.

Figure 10:
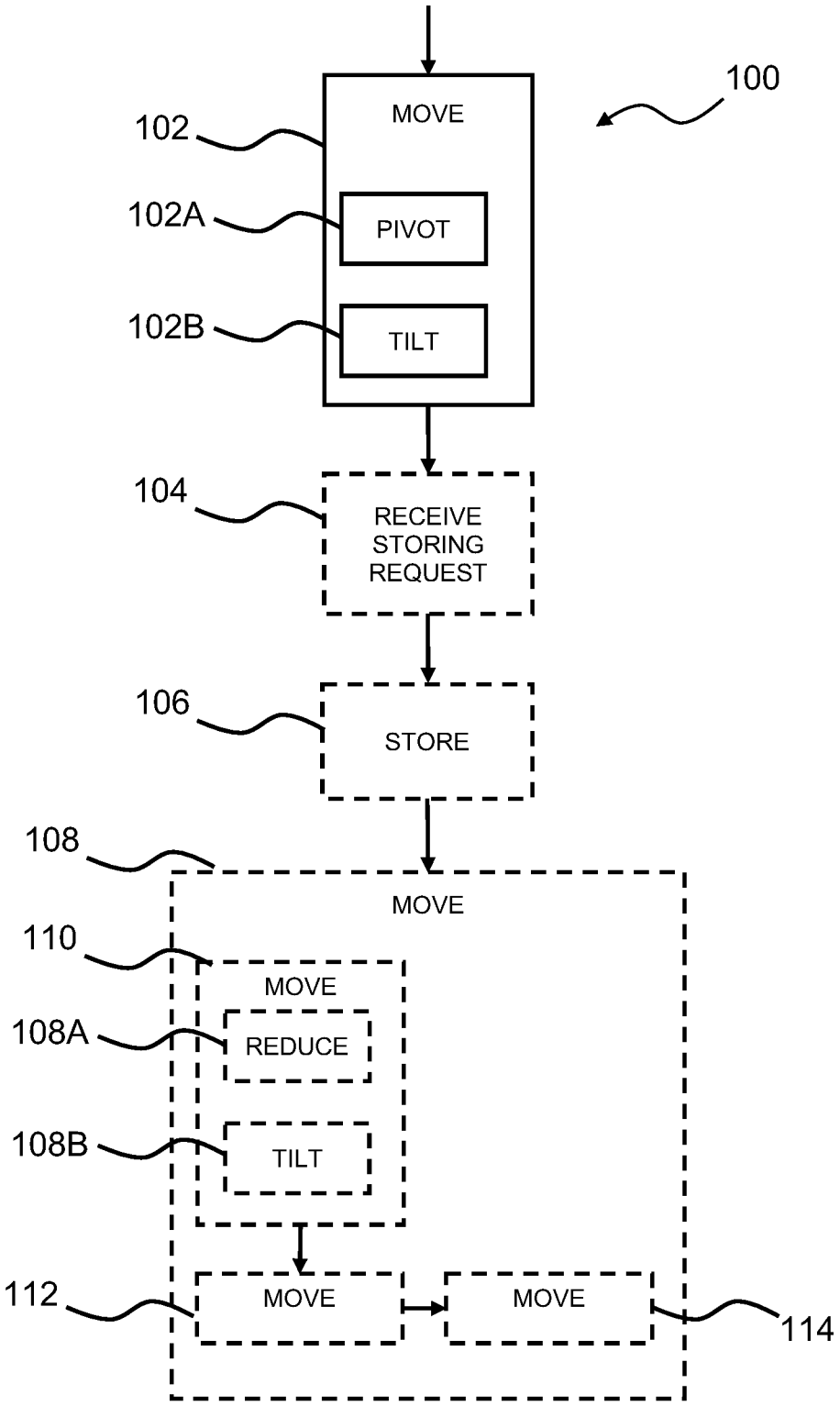
FIG. 10 is a flow diagram of an exemplary method according to the disclosure.

FIG. 10 is a flow diagram of an exemplary method 100 of operating a bed system comprising a bed frame and a mattress assembly pivotably mounted on the bed frame for pivoting the mattress assembly about a pivot axis to form a pivot angle between the mattress assembly and a longitudinal axis of the bed frame, the mattress assembly comprising a back part, a seat part and a leg part, wherein a back normal of the back part and the pivot axis forms a back angle, a seat normal of the seat part and the pivot axis forms a seat angle, and a leg normal of the leg part and the pivot axis forms a leg angle, the method 100 comprising moving 102 the mattress assembly from a first position to a second position, wherein moving 102 the mattress assembly from a first position to a second position comprises pivoting 102A the mattress assembly in a range from 30 degrees to 80 degrees about the pivot axis and tilting 1028 a leg part of the mattress assembly at least 45 degrees. The method 100 optionally comprises receiving 104 a storing request via a user interface, and storing 106 one or more bed settings (position settings) in accordance with the storing request.

The method 100 optionally comprises moving 108 the mattress assembly to the first position, wherein moving 108 the mattress assembly to the first position comprises reducing 108A a primary part angle between the leg normal of the leg part and the seat normal of the seat part and tilting 1088 the back part optionally in accordance with a determination that a first primary criterion is satisfied.

The method 100 comprises moving 108 the mattress assembly to the first position, wherein moving 108 the mattress assembly to the first position comprises moving 110 the mattress assembly to a pivoted intermediate position; pivoting 112 the mattress assembly to a non-pivoted intermediate position; and moving 114 the mattress assembly from the non-pivoted intermediate position to the first position.

Figure 11:
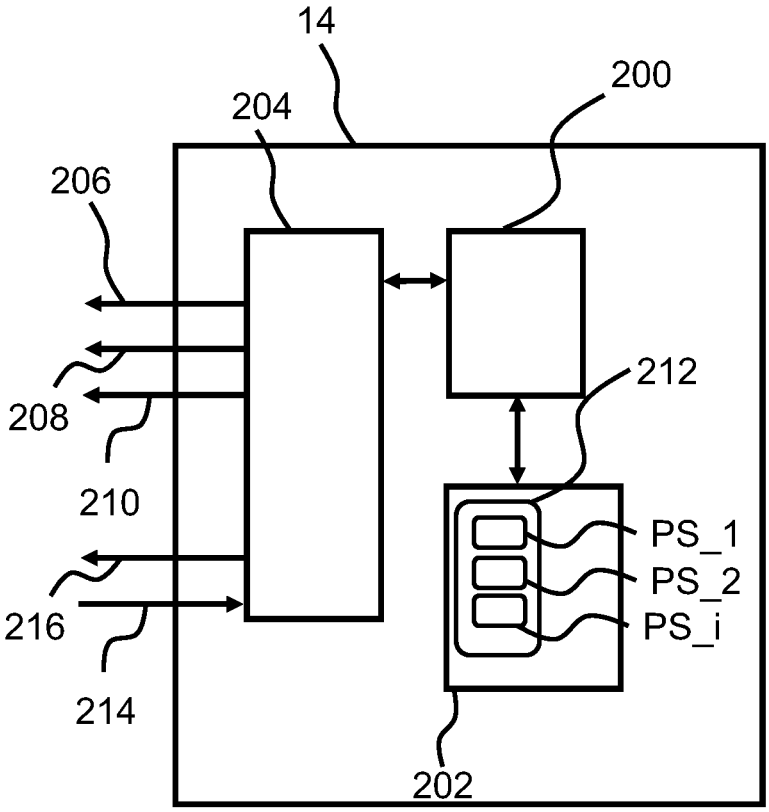
FIG. 11 is a block diagram of an exemplary controller device.

FIG. 11 is a block diagram of an exemplary controller device 14. The controller device 14 comprises a processing unit 200, a memory 202 connected to and/or integrated in the processing unit, and an interface 204 for connecting the controller device to a user interface and one or more actuators. The interface 204 may comprise a wired interface and/or a wireless interface. The controller device 14 transmits control signals 206, 208, 210 to actuators in accordance with bed settings 212 stored in the memory 202. The bed settings 212 include first position settings PS_1, second position settings PS_2 and optionally intermediate settings. The control signals 206, 208, 210 are based on wired and/or wireless input signals 214, such as storing request(s) and position request(s), such as first position request and/or second position request, from the user interface wired or wirelessly connected to the controller device 14. Optionally, the controller device is configured to transmit a light control signal 216 for controlling a light assembly of the bed system. Light control signal 216 may comprise a wired or wireless first light control signal for wired or wireless control of light assembly connected to the controller device, e.g. light assembly 20. Light control signal 216 may comprise a wired or wireless second light control signal for wired or wireless control of one or more external light sources/light controller. An external light source may be a ceiling lamp, a bed platform lamp, tabletop lamp, or a wall-mounted lamp.

The controller device 14 is configured to operate the bed system by the control signals 206, 208, 210, 216, in accordance with or based on the position settings PS_1, PS_2, PS_i in the memory, e.g. by moving the mattress assembly from a position (e.g. first position) to another position (e.g. second position), and in accordance with the input signals 214 from the user interface.

The use of the terms "first", "second", "third" and "fourth", "primary", "secondary", "tertiary" etc. does not imply any particular order, but are included to identify individual elements. Moreover, the use of the terms "first", "second", "third" and "fourth", "primary", "secondary", "tertiary" etc. does not denote any order or importance, but rather the terms "first", "second", "third" and "fourth", "primary", "secondary", "tertiary" etc. are used to distinguish one element from another. Note that the words "first", "second", "third" and "fourth", "primary", "secondary", "tertiary" etc. are used here and elsewhere for labelling purposes only and are not intended to denote any specific spatial or temporal ordering.

Furthermore, the labelling of a first element does not imply the presence of a second element and vice versa.

It may be appreciated that FIGS. 1-11 comprise some modules or operations which are illustrated with a solid line and some modules or operations which are illustrated with a dashed line. The modules or operations which are comprised in a solid line are modules or operations which are comprised in the broadest example embodiment. The modules or operations which are comprised in a dashed line are example embodiments which may be comprised in, or a part of, or are further modules or operations which may be taken in addition to the modules or operations of the solid line example embodiments. It should be appreciated that these operations need not be performed in order presented.

Furthermore, it should be appreciated that not all of the operations need to be performed. The exemplary operations may be performed in any order and in any combination.

It is to be noted that the word "comprising" does not necessarily exclude the presence of other elements or steps than those listed.

It is to be noted that the words "a" or "an" preceding an element do not exclude the presence of a plurality of such elements.

It should further be noted that any reference signs do not limit the scope of the claims, that the exemplary embodiments may be implemented at least in part by means of both hardware and software, and that several "means", "units" or "devices" may be represented by the same item of hardware.

The various exemplary methods, devices, and systems described herein are described in the general context of method steps processes, which may be implemented in one aspect by a computer program product, embodied in a computer-readable medium, including computer-executable instructions, such as program code, executed by computers in networked environments. A computer-readable medium may include removable and non-removable storage devices including, but not limited to, Read Only Memory (ROM), Random Access Memory (RAM), compact discs (CDs), digital versatile discs (DVD), etc. Generally, program modules may include routines, programs, objects, components, data structures, etc. that perform specified tasks or implement specific abstract data types. Computer-executable instructions, associated data structures, and program modules represent examples of program code for executing steps of the methods disclosed herein. The particular sequence of such executable instructions or associated data structures represents examples of corresponding acts for implementing the functions described in such steps or processes.

Although features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications, and equivalents.

LIST OF REFERENCES

2 bed system
4 bed frame
6 mattress assembly
8 back part
10 seat part
12 leg part
14 controller device
16 user interface
18 foot part
20 light assembly
22 first bed rail
24 second bed rail
26 back actuator
28 leg actuator
100 method of operating a bed system
102 moving the mattress assembly from a first position to a second position
102A pivoting the mattress assembly
1028 tilting a leg part of the mattress assembly
104 receiving a storing request
106 storing one or more bed settings
108 moving the mattress assembly to the first position
108A reducing a primary part angle
108B tilting the back part
110 moving mattress assembly to pivoted intermediate position
112 pivoting/moving mattress assembly to non-pivoted intermediate position
114 moving the mattress assembly from the non-pivoted intermediate position to the first position
200 processing unit of controller device
202 memory
204 interface
206 back control signal from the controller device
208 leg control signal from the controller device
210 pivot control signal from the controller device.
212 bed settings
214 input signals from user interface
216 light control signal
D_L longitudinal direction of bed frame
D_L_MA longitudinal direction of matrees assembly
N_B back normal
N_L leg normal
N_S seat normal
PS_1 first position settings
PS_2 second position settings
PS_i intermediate position settings
X_L longitudinal axis
X_P pivot axis
V_B back angle
V_L leg angle
V_P pivot angle
V_P_P primary part angle
V_S seat angle
V_S_P secondary part angle

The invention claimed is:

1. A bed system comprising a bed frame and a mattress assembly pivotably mounted on the bed frame for pivoting the mattress assembly about a pivot axis to form a pivot angle between a longitudinal axis of the mattress assembly and a longitudinal axis of the bed frame, wherein the bed frame has a bed frame width and the mattress assembly has a mattress assembly width, wherein the pivot axis of the mattress assembly is normal to a plane containing the bed frame width and bed frame longitudinal direction and the mattress assembly width and mattress assembly longitudinal direction, wherein the pivot angle is 0 degrees when the longitudinal axes of the mattress assembly and bed frame are parallel, wherein the mattress assembly comprising a back part, a seat part and a leg part, wherein a back normal of the back part and the pivot axis of the mattress assembly forms a back angle, a seat normal of the seat part and the pivot axis of the mattress assembly forms a seat angle, and a leg normal of the leg part and the pivot axis of the mattress assembly forms a leg angle, the bed system comprising a controller device, and wherein the controller device is configured to: move the mattress assembly from a first position to a second position, wherein, in the first position, the pivot angle is a first pivot angle, the back angle is a first back angle, the seat angle is a first seat angle and leg angle is a first leg angle, and in the second position, the pivot angle is a second pivot angle in a range from 30 degrees to 80 degrees, the back angle is a second back angle, the seat angle is a second seat angle and the leg angle is a second leg angle larger than 45 degrees.

2. Bed system according to claim 1, wherein the second pivot angle is in the range from 40 degrees to 75 degrees.

3. Bed system according to claim 1, wherein, in the second position, the second seat angle is less than 30 degrees and the second back angle is larger than 45 degrees.

4. Bed system according to claim 1, wherein, in the second position, a primary part angle between the leg normal of the leg part and the seat normal of the seat part is a second primary part angle larger than 90 degrees.

5. Bed system according to claim 1, wherein, in the second position, a secondary part angle between the back normal of the back part and the seat normal of the seat part is a second secondary part angle in the range from 45 degrees to 110 degrees.

6. Bed system according to claim 1, wherein the controller device is configured to:

move the mattress assembly to a third position, wherein, in the third position, the pivot angle is a third pivot angle in the range from 80 degrees to 150 degrees.

7. Bed system according to claim 1, wherein the controller device is configured to move the mattress assembly to the first position, wherein to move the mattress assembly to the first position comprises:

reducing a primary part angle between the leg normal of the leg part and the seat normal of the seat part;

determining if a first primary criterion is satisfied; and in accordance with a determination that the first primary criterion is satisfied, tilting the back part.

8. Bed system according to claim 1, wherein the controller device is configured to move the mattress assembly to the first position, wherein to move the mattress assembly to the first position comprises moving the mattress assembly to a pivoted intermediate position; pivoting the mattress assembly to a non-pivoted intermediate position; and moving the mattress assembly from the non-pivoted intermediate position to the first position.

9. Bed system according to claim 1, wherein to move the mattress assembly to the second position comprises moving the mattress assembly to a second height.

10. Bed system according to claim 1, wherein the controller is configured to receive a storing request via a user interface, and store one or more bed settings in accordance with the storing request.

11. Bed system according to claim 1, wherein the bed system comprises a light assembly, and wherein to move the mattress assembly from the first position to the second position comprises:

increasing the pivot angle;

determining if a first light criterion is satisfied; and in accordance with a determination that the first light criterion is satisfied, turning on the light assembly.

12. Method of operating a bed system comprising a bed frame and a mattress assembly pivotably mounted on the bed frame for pivoting the mattress assembly about a pivot axis to form a pivot angle between the mattress assembly and a longitudinal axis of the bed frame, wherein the bed frame has a bed frame width and the mattress assembly has a mattress assembly width, wherein the pivot axis of the mattress assembly is normal to a plane containing the bed frame width and bed frame longitudinal direction and the mattress assembly width and mattress assembly longitudinal direction, wherein the pivot angle is 0 degrees when the longitudinal axes of the mattress assembly and bed frame are parallel, wherein, the mattress assembly comprising a back part, a seat part and a leg part, wherein a back normal of the back part and the pivot axis of the mattress assembly forms a back angle, a seat normal of the seat part and the pivot axis of the mattress assembly forms a seat angle, and a leg normal of the leg part and the pivot axis of the mattress assembly forms a leg angle, the method comprising:

moving the mattress assembly from a first position to a second position, wherein moving the mattress assembly from a first position to a second position comprises pivoting the mattress assembly in a range from 30 degrees to 80 degrees about the pivot axis of the mattress assembly and tilting a leg part of the mattress assembly at least 45 degrees.

13. Method according to claim 12, wherein the method comprises receiving a storing request via a user interface, and storing one or more bed settings in accordance with the storing request.

14. Method according to claim 12, wherein the method comprises moving the mattress assembly to the first position, wherein moving the mattress assembly to the first position comprises:

reducing a primary part angle between the leg normal of the leg part and the seat normal of the seat part;

determining if a first primary criterion is satisfied; and in accordance with a determination that the first primary criterion is satisfied, tilting the back part.

15. Method according to claim 12, wherein the method comprises moving the mattress assembly to the first position, wherein moving the mattress assembly to the first position comprises moving the mattress assembly to a pivoted intermediate position; pivoting the mattress assembly to a non-pivoted intermediate position; and moving the mattress assembly from the non-pivoted intermediate position to the first position.

* * * * *